US012612732B2

(12) United States Patent
Hiltunen et al.

(10) Patent No.: US 12,612,732 B2
(45) Date of Patent: Apr. 28, 2026

(54) AQUEOUS EMULSION AND METHOD FOR MAKING IT

(71) Applicant: KEMIRA OYJ, Helsinki (FI)

(72) Inventors: Jaakko Hiltunen, Espoo (FI); Elisabeth Lackinger-Csarmann, Krems (AT); Reetta Strengell, Espoo (FI)

(73) Assignee: KEMIRA OYJ, Helsinki (FI)

( * ) Notice: Subject to any disclaimer, the term of this patent is extended or adjusted under 35 U.S.C. 154(b) by 620 days.

(21) Appl. No.: 18/008,662

(22) PCT Filed: Jun. 23, 2021

(86) PCT No.: PCT/FI2021/050482
§ 371 (c)(1),
(2) Date: Dec. 6, 2022

(87) PCT Pub. No.: WO2021/260273
PCT Pub. Date: Dec. 30, 2021

(65) Prior Publication Data

US 2023/0243101 A1 Aug. 3, 2023

(30) Foreign Application Priority Data

Jun. 26, 2020 (FI) ..... 20205679

(51) Int. Cl.
*D21H 17/23* (2006.01)
*D21H 21/16* (2006.01)

(52) U.S. Cl.
CPC ..... *D21H 17/23* (2013.01); *D21H 21/16* (2013.01)

(58) Field of Classification Search
CPC ..... D21H 21/16; D21H 17/23; D21H 17/24; D21H 17/72; D21H 17/14; D21H 17/16; D21H 17/17; D21H 17/15; D21H 17/18; D21H 17/28; D21H 17/36; D21H 17/70; D21H 21/24; D21H 23/04; D21H 17/20; D21H 17/455; D21H 17/62; D21H 17/71; D21H 17/31; C08H 6/00; C08L 97/005; C08L 93/04
See application file for complete search history.

(56) References Cited

U.S. PATENT DOCUMENTS

| | | | | |
|---|---|---|---|---|
| 6,268,414 | B1 * | 7/2001 | Lin | D21H 21/16 162/158 |
| 6,315,824 | B1 | 11/2001 | Lauzon | |
| 2004/0206274 | A1 | 10/2004 | Kruckel | |
| 2008/0017340 | A1 | 1/2008 | Sundberg et al. | |
| 2010/0166968 | A1 | 7/2010 | Doherty et al. | |
| 2016/0348316 | A1 | 12/2016 | Reetta et al. | |
| 2017/0009100 | A1 | 1/2017 | Ling et al. | |
| 2019/0382959 | A1 | 12/2019 | Bergmark et al. | |

FOREIGN PATENT DOCUMENTS

| | | | |
|---|---|---|---|
| CN | 103806332 | A | 5/2014 |
| CN | 109826048 | A | 5/2019 |
| FI | 951682 | A | 10/1995 |
| GB | 954526 | A | 4/1964 |
| WO | 03074787 | A1 | 9/2003 |

OTHER PUBLICATIONS

"ASA Optimisation—Control of Particle Size, Stability and Hydrolysis" Martorana et al. Professional Papermaking 5 (2), pp. 34-42 (2008) (Year: 2008).*
"Characterization of Two Novel Bio-based Materials from Pulping Process Side Streams: Ecohelix and CleanFlow Black Lignin" Abbadessa et al. BioResources 2018, 13(4), 7606-7627 (Year: 2018).*
"Valorization of Lignin—Carbohydrate Complexes from Hydrolysates of Norway Spruce: Efficient Separation, Structural Characterization, and Antioxidant Activity" Zhang et al. ACS Sustainable Chem. Eng. 2019, 7, 1447-1456 (Year: 2019).*
"Layer-by-layer assembly of sustainable lignin-based coatings for food packaging applications" Abbadessa et al. Progress in Organic Coatings 182 (2023) 107676 (Year: 2023).*
Lehtonen et al. "Phenolic residues in spruce galactoglucomannans improve stabilization of oil-in-water emulsions", Journal of Colloid and Interface Science 2018, 512, 536-547 (Year: 2018).*
Zhang et al. "Valorization of Lignin-Carbohydrate Complexes from Hydrolysates of Norway Spruce: Efficient Separation, Structural Characterization, and Antioxidant Activity" ACS Sustainable Chem. Eng. 2019, 7, 1447-1456 (Year: 2019).*
Martorana et al. "ASA Optimisation—Control of Particle Size, Stability and Hydrolysis" Presentation at the International Munich Paper Symposium, 2008 (Year: 2008).*
Abbadessa et al. (Abbadessa 1) "Characterization of Two Novel Bio-based Materials from Pulping Process Side Streams: Ecohelix and CleanFlow Black Lignin" BioResources 2018, 13(4) 7606-7627 (Year: 2018).*
Abbadessa et al. (Abbadessa 2) "Layer-by-layer assembly of sustainable lignin-based coatings for food packaging applications" Progress in Organic Coatings 2023, 182, 107676 (Year: 2023).*
English translation of Search report in corresponding application CN2021800441750, dated on Dec. 22, 2023.
International Search Report and Written Opinion in Application No. PCT/FI2021/050482, mailed Sep. 20, 2021, 12 pages.

(Continued)

*Primary Examiner* — Amber R Orlando
*Assistant Examiner* — Ryan Patrick Loughran
(74) *Attorney, Agent, or Firm* — Meunier Carlin & Curfman LLC

(57) ABSTRACT

The invention relates to an aqueous emulsion of a hydrophobic anhydride-based sizing agent, prepared by homogenizing the said anhydride-based sizing agent in an aqueous phase which comprises a stabilizer, which is an anionic lignin-carbohydrate complex, where lignin and carbohydrate are covalently bound with each other. The invention further relates to a use of this anionic lignin-carbohydrate complex as a stabilizer as well as to a method for making an aqueous emulsion of a hydrophobic anhydride-based sizing agent.

14 Claims, No Drawings

(56) References Cited

OTHER PUBLICATIONS

Search Report in Finnish Application No. 20205679, dated Jan. 19, 2021, 2 pages.

Abbadessa, A. et al. "Characterization of two novel bio-based materials from pulping Process side streams: Ecohelix and CleanFlow black lignin." In: BioResources Aug. 22, 2018, vol. 13, No. 4, pp. 7606-7627.

Dominguez-Robles, Juan, et al. "Aqueous acetone fractionation of kraft, organosolv and soda lignins", International Journal of Biological Macromolecules Jan. 2018 vol. 106, pp. 979-987.

* cited by examiner

AQUEOUS EMULSION AND METHOD FOR MAKING IT

CROSS REFERENCES

This application is a national stage application of international application number PCT/FI2021/050482 filed on Jun. 23, 2021 and claiming priority to Finnish national application FI20205679 filed on Jun. 26,2020.

FIELD OF THE INVENTION

The present invention relates to an aqueous emulsion, use of an anionic lignin-carbohydrate complex, and to a method for making an aqueous emulsion according to the preambles of the enclosed independent claims.

BACKGROUND OF THE INVENTION

Paper, board or the like are sized in order to decrease or prevent the penetration of water and other liquids into its structure. In internal sizing chemical sizing agents are added to the furnish, where they interact with the fibres in order to increase the water repellency of the paper or board. Alternatively, or in addition, in surface sizing chemical sizing agents can be added on the surface of the partially dried paper, board or the like, in order to seal the surface and decrease the liquid penetration.

Hydrophobic anhydride-based sizing agents, such as alkenyl succinic anhydride, are commonly used in sizing of paper, board and the like. The anhydride-based sizing agents are homogenized with water to provide an aqueous oil-in-water emulsion which is then used in sizing. The aqueous sizing emulsions are usually stabilized by using stabilizing agents, most commonly starch. However, the temporal stability of the emulsions comprising anhydride-based sizing agents is not always fully satisfactory, which requires that the prepared emulsions must be used in the sizing process during a relatively short time after their preparation. Otherwise the hydrophobic size particles in the emulsion may coalesce, which causes deterioration of the emulsion properties.

Furthermore, use of starch as a stabilizing agent in sizing emulsions may cause an increased risk for bacterial growth and deposit problems in the manufacturing process of paper or board, as the starch provides nutrition for bacteria existing in the process.

In view of the above, there is a need for new effective stabilizer that can be used for stabilizing aqueous emulsions of hydrophobic anhydride-based sizing agents. Under the present strive for sustainability the stabilizer would preferably originate from renewable sources and would not be based on petrochemical products.

SUMMARY OF THE INVENTION

An object of this invention is to minimise or even eliminate the disadvantages existing in the prior art.

Another object of the present invention is also to provide an aqueous emulsion of a hydrophobic anhydride-based sizing agent that is stable and easy to make.

A further object of this invention is to provide a new simple method for making an aqueous emulsion of a hydrophobic anhydride-based sizing agent.

These objects are attained with the invention having the characteristics presented below in the characterising parts of the independent claims. Some preferable embodiments are disclosed in the dependent claims.

The features recited in the dependent claims and the embodiments disclosed in the description are mutually freely combinable unless otherwise explicitly stated.

The exemplary embodiments presented in this text and their advantages relate by applicable parts to all aspects of the invention, even though this is not always separately mentioned.

Typical aqueous emulsion of a hydrophobic anhydride-based sizing agent according to the present invention is prepared by homogenizing the said anhydride-based sizing agent in an aqueous phase which comprises a stabilizer, which is an anionic lignin-carbohydrate complex.

Typical use of an anionic lignin-carbohydrate complex according to the present invention is as a stabilizer for an aqueous emulsion of a hydrophobic anhydride-based sizing agent.

Typical method according to the present invention for making an aqueous emulsion of a hydrophobic anhydride-based sizing agent comprises

- providing an aqueous phase comprising a stabilizer, which is an anionic lignin-carbohydrate complex,
- mixing a hydrophobic anhydride-based sizing agent to the aqueous phase to form a mixture, and
- homogenizing the mixture to form an aqueous emulsion

DETAILED DESCRIPTION OF THE INVENTION

Now it has been surprisingly found out that the stability of an aqueous emulsion comprising a hydrophobic anhydride-based sizing agent is improved when an anionic lignin-carbohydrate complex, where the lignin and carbohydrate are covalently bound with each other, is used as a stabilizer. The scientific reason for the improvement is not yet presently fully understood. The obtained emulsion according to the present invention provides at least as good other properties, if not better, as the emulsions prepared by using conventional stabilizers, such as starch, and in addition an unexpected emulsion stability under a prolonged time. This means that the emulsions according to the present invention behave in practical sizing applications in a same way as the known emulsions and provide at least the same sizing effect. As the emulsion of the present invention show, however, a superior emulsion stability in comparison to known emulsions, it enables a more relaxed application schedule, e.g. at the time of process disturbances. Furthermore, the lignin-carbohydrate complex where the lignin and carbohydrate are covalently bound with each other is probably less palatable for the process bacteria, which might help in minimising the risk for bacterial overgrowth and formation of bacterial deposits in the manufacturing process of paper, board, or the like.

In the present context the hydrophobic anhydride-based sizing agent may be any anhydride-based substance typically used for sizing, preferably internal sizing, in the manufacture of paper, board or the like. Preferably, the hydrophobic anhydride-based sizing agent may be selected from a group consisting of alkenyl succinic anhydride, maleated vegetable oils, fatty acid anhydrides and any of their mixtures. Fatty acid anhydrides may be based on saturated or unsaturated fatty acids, or mixtures of saturated and/or unsaturated fatty acids. The chain length of the suitable fatty acid anhydrides may be >12 carbon atoms, preferably 12-24 carbon atoms. Suitable fatty acid anhydrides are, for example, oleic, linoleic, linolenic, arachidic, behenic and stearic acid anhydrides. Unsaturated fatty acid anhydrides comprising chain length of 18 carbon atoms, i.e. double bonds in their chain, are preferable. According to one embodiment fatty acid anhydrides selected from oleic, linoleic, linolenic acid anhydrides and their mixtures are preferable. According one embodiment the fatty acid anhydride may be derived from tall oil, sunflower oil, rapeseed oil, soybean oil, linseed oil or any of their mixtures.

According to one embodiment the hydrophobic anhydride-based sizing agent may comprise or be maleated vegetable oil, such as sunflower oil, rapeseed oil, safflower oil, olive oil, hazelnut oil, or any of their mixtures. Preferably the hydrophobic anhydride-based sizing agent may comprise or be maleated high oleic sunflower oil (MSOHO) or maleated rapeseed oil (MRSO), high oleic sunflower oil being especially preferable. Typical oleic acid contents of some suitable vegetable oils are as follows: high oleic sunflower oil 70-85%, rapeseed oil 51-67%, olive oil 58-83% and hazelnut oil 77-84%.

According to one especially preferable embodiment hydrophobic anhydride-based sizing agent comprises or is alkenyl succinic anhydride.

The anionic lignin-carbohydrate complex is a natural polymeric complex that comprises lignin and carbohydrate (s), preferably hemicellulose(s), covalently bound with each other. The lignin-carbohydrate complex is thus a conjugate of lignin and carbohydrate(s), which are irreversibly bound which each other to a common structure. The anionic lignin-carbohydrate complex may have a branched structure. For example, the lignin or the carbohydrate may form a backbone structure for the complex and the other component, either carbohydrate or lignin, may form pendant groups, which are covalently bound to the backbone structure.

The lignin-carbohydrate complex may be formed of lignin and one or more of carbohydrates, such as hemicelluloses. The carbohydrate(s) in the lignin-carbohydrate complex may preferably be formed from monosaccharides, such as mannose, galactose, glucose, xylose and/or arabinose, or their fragments or residues; or the carbohydrate(s) may be said monosaccharide(s) and/or their fragments or residues. The exact amount of the monosaccharides in the lignin-carbohydrate complex and their relative ratios depend on the wood species, e.g. hardwood/softwood, which has been used in the pulping process and from which lignin-carbohydrate complex originates. The monosaccharides may be present in the lignin-carbohydrate complex as sugar residues, covalently bound to the lignin.

The anionic lignin-carbohydrate complex may comprise various anionic functional groups, such as sulfonate groups, carboxyl groups and/or phenolic groups. The lignin-carbohydrate complex may comprise, for example, >1300-1700 μmol/g, preferably 1400-1600 μmol/g of sulfonate groups; 300-500 μmol/g, preferably 350-450 μmol/g of carboxyl groups; and/or 125-250 μmol/g, preferably 150-225 μmol/g of phenolic groups.

The lignin-carbohydrate complex, suitable for use in the present invention, may be obtained from a side stream of a pulping process. In one embodiment, a suitable lignin-carbohydrate complex may be obtained by enzymatic treatment of lignin-carbohydrate material originating from a pulping process. For example, the lignin-carbohydrate complex may be obtained by isolating lignin-carbohydrate material from side streams of wood pulping processes by filtration, such as membrane filtration, and by processing the said isolated lignin-carbohydrate material by enzymatic processing employing preferably laccase enzyme. Alternatively, lignin-carbohydrate complex may be isolated from lignocellulosic material, such as wood or pulp, by using separation and fractionation methods known as such. For example, it is possible to isolate lignin-carbohydrate complexes by fractionating lignin from an industrial process, such as kraft pulping or sulphite pulping. Suitable lignin fractionating methods include, for example, solvent fractionation or precipitation fractionation. In solvent fractionation various organic solvents and their binary mixtures may be employed, such as acetone-hexane, acetone-water, ethanol-water, propyleneglycol monomethyl ether-water. Such fractionation method is described, inter alia, in Int. J. Biol. Macromolecules 106 (2018) 979-987.

According to one preferable embodiment of the invention the anionic lignin-carbohydrate complex is an anionic lignosulfonate-carbohydrate complex. It can be obtained, for example, by membrane filtration of a pre-hydrolysis mixture from a sulphite pulping process of wood, and treated by an enzymatic oxidative treatment, preferably by a laccase enzyme. Preferably the filtered pre-hydrolysis mixture is obtained from a sulphite pulping process of wood. The pre-hydrolysis mixture may contain wood-based components and pulping chemicals. Suitable anionic lignosulfonate-carbohydrate complex is disclosed e.g. in BioResources 13(4), 7606-7627, 2018, and they are commercially available from Ecohelix AB, Sweden.

The anionic lignin-carbohydrate complex may have an anionic charge density less than −0.2 meq/g, preferably −0.5 meq/g, more preferably less than −0.85 meq/g, measured at pH 7. The anionic charge density of the complex may be from −0.2 meq/g to −2.5 meq/g, preferably from −0.5 meq/g to −2.4 meq/g, more preferably from −0.85 meq/g to −2.3 meq/g, measured at pH 7. Sometimes the anionic charge density of the complex may be from −0.5 meq/g to −1.75 meq/g, preferably from −0.85 to −1.5 meq/g, measured at pH 7. The anionic lignin-carbohydrate complex may even have an anionic charge density from −2.0 meq/g to −2.3 meq/g, preferably from −2.1 meq/g to −2.2 meq/g or to −2.15 meq/g, measured at pH 7. All charge density values are given as per dry substance, and measured by using a Mütek Particle Charge Detector.

The lignin-carbohydrate complex may have a weight average molecular weight >3500 g/mol, preferably >4000 g/mol, more preferably >5000 g/mol. The lignin-carbohydrate complex may have the weight average molecular weight MW in a range of 3500-90 000 g/mol, preferably 4 000-80 000 g/mol, more preferably 5000-70 000 g/mol.

According to one preferable embodiment, the lignin-carbohydrate complex may preferably have relatively high molecular weight. It is assumed, without wishing to be bound by a theory that the high molecular weight provides at least some of the surprising effects that have been observed. The lignin-carbohydrate complex may have a weight average molecular weight MW >8000 g/mol, preferably >10 000 g/mol, more preferably >12 000 g/mol or >15 000 g/mol, sometimes even >20 000 g/mol or >25 000 g/mol. The lignin-carbohydrate complex may have the weight average molecular weight MW in a range of 8 000-50 000 g/mol or 10 000-45 000 g/mol, preferably 12 000-40 000 g/mol or 15 000-37 000 g/mol. Sometimes the lignin-carbohydrate complex may have the weight average molecular weight MW in a range of 20 000-45 000 g/mol, preferably 25 000-40 000 g/mol, more preferably 25 000-35 000 g/mol or 25 000-27 000 g/mol. It is also possible that the lignin-carbohydrate complex may have the weight average molecular weight MW in a range of 15 000-120 000 g/mol or 20 000-90 000 g/mol, preferably 25 000-80 000 g/mol, more preferably 30 000-70 000 g/mol.

The lignin-carbohydrate complex may comprise lignin and carbohydrates, preferably hemicellulose, in a ratio from 90:10 to 10:90, preferably from 80:20 to 20:80, more preferably from 75:25 to 25:75 (lignin:carbohydrate). According to one embodiment of the invention the lignin-carbohydrate complex may comprise at least 10 weight-%, sometimes preferably at least 15 weight-% of carbohydrate (s), preferably hemicellulose(s), calculated from total dry weight of the complex. The lignin-carbohydrate complex may comprise carbohydrate(s) in a range of 10-40 weight-%, preferably 10-30 weight-% or 15-25 weight-%, calculated from total dry weight of the complex.

According to one embodiment of the invention, the aqueous emulsion comprises the lignin-carbohydrate complex and the hydrophobic anhydride-based sizing agent in a weight ratio from 0.05:1 to 0.5:1, preferably from 0.075:1 to 0.3:1, even more preferably from 0.1:1 to 0.25:1. It has been unexpectedly found out that even small amounts of lignin-carbohydrate complex provide valuable emulsion stabilisation effect in the prepared aqueous emulsions. In this manner it is possible to reduce the total amount of stabilizer, and still obtain desired emulsion stability without compromising other emulsion properties. The emulsion may comprise 0.01-1 weight-%, preferably 0.05-0.7 weight-%, more preferably 0.07-0.5 weight-% or 0.07-0.3 weight-%, of lignin-carbohydrate complex, calculated from total weight of the emulsion.

Typically the emulsion according to the present invention may comprise at least 0.5 weight-%, preferably 0.5-10 weight-%, more preferably 0.5-5 weight-%, even more preferably 0.75-3.5 weight-%, of the said hydrophobic anhydride-based sizing agent, given as active agent and calculated from the total weight of the emulsion. The hydrophobic anhydride-based sizing agent, such as alkenyl succinic anhydride, which is dispersed in the aqueous continuous phase of the emulsion, may have a particle size D95 in a range of 0.5-10 μm, preferably 0.75-5 μm, more preferably 1-3 μm. In general, the emulsion according to present invention shows size particles which have suitable small particle size for use as a sizing agent in paper and board making applications.

According to one preferable embodiment the aqueous emulsion of the hydrophobic anhydride-based sizing agent is free of starch. Furthermore, the aqueous emulsion is free of other synthetic polymers than the anhydride-based sizing agent. The aqueous emulsion preferably does not contain other solvents than water, i.e. the solvent forming the continuous phase of the emulsion is preferably solely water.

The obtained aqueous emulsion is stable at least 30 minutes, preferably at least 1 hour or at least 2 hours, measured as a change of the particle size D95 as a function of time, wherein the particle size D95 changes less than 10% within the defined time period. This means that the particle size D95 value for the emulsion is measured directly after the preparation of the emulsion and a first D95 value is obtained. After the emulsion is allowed to stand a defined time period, e.g. 30 minutes, preferably 1 hour or 2 hours, the particle size D95 value is measured anew and a second D95 value is obtained. The emulsion is considered stable, when the difference between the first D95 value and the second D95 value is less than 10%, preferably less than 7.5%, more preferably less than 5%.

The pH of the prepared emulsion may be 6.5, preferably more preferably The pH may be, for example, in a range from 2 to 6.5 or from 3 to 6. It has been observed that the stability of the emulsion is further improved when the pH of the emulsion is slightly acidic. The pH of the emulsion may be adjusted to desired level by using conventionally accepted methods, e.g. by addition of a suitable acid. It is possible to adjust the pH of the aqueous phase of the emulsion or the pH of the formed emulsion to the desired pH value.

According to one embodiment of the invention the aqueous emulsion may contain, in addition to the lignin-carbohydrate complex, also other additives, such as emulsifiers, e.g. dioctyl sodium sulfosuccinate. Typically, any other additive originates from the anhydride-based sizing agent. The amount of any other additive in the emulsion is usually small, typically <1 weight-%, more typically <0.1 weight-%, even more typically <0.01 weight-%, calculated from the total weight of the emulsion.

The aqueous emulsion of hydrophobic anhydride-based sizing agent can be prepared simply by mixing the individual components of the emulsion. It is possible to first prepare an aqueous phase comprising the stabilizer, which is an anionic lignin-carbohydrate complex, for example by mixing the stabilizer into water. After that the hydrophobic anhydride-based sizing agent can be mixed to the aqueous phase, and the mixture can be homogenized to form a stable aqueous oil-in-water emulsion. Any suitable high-shear mixing device, which are known as such, can be used for mixing and homogenisation.

The temperature of the aqueous phase during the preparation of the aqueous emulsion may be in a range of 5-90° C., preferably 15-70° C. According to one embodiment the aqueous phase may be heated to a temperature of at least 40° C. before the stabilizer is added to the aqueous phase.

According to one preferable embodiment of the invention the anionic lignin-carbohydrate complex is added to the aqueous phase as a diluted aqueous solution, where the final concentration of the lignin-carbohydrate complex may be <0.6 weight-% or <0.5 weight-%, preferably <0.3 weight-% or <0.25 weight-%, more preferably <0.2 weight-%, sometimes even <0.15 weight-%, calculated from total weight of the emulsion. In some embodiments the anionic lignin-carbohydrate complex is added to the aqueous phase as an diluted aqueous solution, where the final concentration of the lignin-carbohydrate complex may be 0.05-0.5 weight-% or 0.05-0.6 weight-%, preferably 0.075-0.3 weight-% or 0.075-0.25 weight-%, more preferably 0.08-0.2 weight-%, sometimes 0.9-0.15 weight-%, calculated from total weight of the emulsion.

It has been observed that the aqueous emulsion of a hydrophobic anhydride-based sizing agent prepared according to the present invention provides similar sizing performance in the paper and board making as the sizing agents prepared in a conventional manner. It is possible that the sizing agent prepared according to the present invention shows even better sizing performance in the paper and board making.

EXPERIMENTAL

Example 1

An anionic lignin-carbohydrate complex (Ecohelix AB, Sweden) was tested as stabilizer for commercial alkenyl succinic anhydride (FennoSize AS 3100, Kemira Oyj). The anionic lignin-carbohydrate complex was tested at different concentrations: 0.5 weight-% (sample series A), 0.25 weight-% (sample series B) 0.15 weight-% (sample series C). These are the aqueous phase concentrations in the final emulsion. The emulsification was done by using an Ultra Turrax mixing device, mixing time 1 min, speed 10 000 rpm.

The particle size distribution of the obtained emulsion was measured by using laser diffraction particle size distribution analyser (Horiba LA-300). The measurements were made immediately after the emulsification and after the emulsion had stood 30 min.

Emulsification of same commercial alkenyl succinic anhydride to water, final concentration in emulsion 1 weight-%, without any added stabilizer, was used as a reference.

The results are shown in Table 1.

TABLE 1

Results of Example 1

| Sample | Ratio complex:ASA | Particle size at 0 min [μm] D50 | D90 | D95 | Particle size at 30 min [μm] D50 | D90 | D95 |
|---|---|---|---|---|---|---|---|
| A1 | 0.2:1 | 1.4 | 3.3 | 4.5 | 1.6 | 34.2 | 49.0 |
| A2 | 0.1:1 | 1.5 | 3.9 | 5.6 | 2.0 | 30.4 | 54.3 |
| A3 | 0.05:1 | 1.7 | 5.1 | 7.2 | 1.8 | 7.7 | 13.6 |
| B1 | 0.2:1 | 0.9 | 1.4 | 1.7 | 0.8 | 1.4 | 1.7 |
| B2 | 0.1:1 | 1.1 | 2.0 | 2.4 | 1.1 | 2.3 | 2.9 |
| B3 | 0.05:1 | 1.2 | 2.5 | 3.2 | 1.3 | 3.5 | 4.8 |
| C1 | 0.2:1 | 0.6 | 0.8 | 0.9 | 0.6 | 0.9 | 0.9 |
| C2 | 0.1:1 | 0.8 | 1.1 | 1.3 | 0.8 | 1.1 | 1.3 |
| C3 | 0.05:1 | 1.0 | 1.9 | 2.4 | 1.1 | 2.1 | 2.7 |
| Reference | — | 1.1 | 2.1 | 2.6 | 1.1 | 3.0 | 5.4 |

It is seen from Table 1 that good particle size distribution and stable emulsion can be obtained with 0.25 weight-% of the anionic lignin-carbohydrate complex is used as stabilizer. Even better results, for both the particle size distribution and stability, can be obtained when the anionic lignin-carbohydrate complex is used in amount of 0.15 weight-% in the final emulsion.

Example 2

The anionic lignin-carbohydrate complex (Ecohelix AB, Sweden) is the same as in Example 1 and it was tested as stabilizer for three commercial alkenyl succinic anhydrides ASA1 (FennoSize AS 3100, Kemira Oyj), ASA2 (FennoSize AS 1000, Kemira Oyj) and ASA3 (FennoSize MO 30, Kemira Oyj). Alkenyl succinic anhydride ASA3 contained maleated sunflower oil. The anionic lignin-carbohydrate complex was in form of a solution, having solids content of 27 weight-%, pH 5.5.

The anionic lignin-carbohydrate complex was tested at different concentrations: 0.25 weight-% and 0.5 weight-%. These are the concentrations in the final emulsion. The emulsification was done by using a Cavitron emulsifier device.

The particle size distribution of the obtained emulsion was measured by using laser diffraction particle size distribution analyser (Horiba LA-300). The measurements were made immediately after the emulsification and after the emulsion had stood 30 min. The used amounts and results are shown in Table 2.

TABLE 2

Results of Example 2.

| Size | Complex concentration, final [w-%] | Ratio complex:ASA | Particle size at 0 min [μm] D50 | D90 | D95 | Particle size at 30 min [μm] D50 | D90 | D95 |
|---|---|---|---|---|---|---|---|---|
| ASA1 | 0.5 | 0.3:1 | 1.8 | 3.5 | 4.3 | 2.0 | 3.8 | 4.6 |
| ASA1 | 0.5 | 0.2:1 | 1.5 | 3.0 | 3.8 | 1.7 | 3.0 | 3.6 |
| ASA1 | 0.5 | 0.1:1 | 1.4 | 2.5 | 3.1 | 1.4 | 2.5 | 2.9 |
| ASA1 | 0.25 | 0.2:1 | 1.5 | 2.5 | 2.9 | 1.6 | 2.7 | 3.3 |
| ASA1 | 0.25 | 0.1:1 | 1.3 | 2.3 | 2.6 | 1.4 | 2.5 | 3.0 |
| ASA2 | 0.25 | 0.1:1 | 1.9 | 3.3 | 3.8 | 1.8 | 3.4 | 4.2 |
| ASA3 | 0.25 | 0.1:1 | 1.5 | 2.9 | 3.5 | 1.4 | 2.8 | 3.5 |

It is seen from Table 2 that that good particle size distribution and stable emulsion can be obtained with 0.25 weight-% of the anionic lignin-carbohydrate complex is used as stabilizer.

The project leading to this application has received funding from the Bio Based Industries Joint Undertaking (JU) under grant agreement No 837866. The JU receives support from the European Union's Horizon 2020 research and innovation programme and the Bio Based Industries Consortium.

Even if the invention was described with reference to what at present seems to be the most practical and preferred embodiments, it is appreciated that the invention shall not be limited to the embodiments described above, but the invention is intended to cover also different modifications and equivalent technical solutions within the scope of the enclosed claims.

The invention claimed is:

1. An aqueous emulsion of a hydrophobic anhydride-based sizing agent, prepared by homogenizing the anhydride-based sizing agent in an aqueous phase which comprises a stabilizer, which is an anionic lignin-carbohydrate complex, where lignin and carbohydrate are covalently bound with each other;

wherein the lignin-carbohydrate complex comprises at least 10 weight-% of carbohydrates, calculated from total dry weight of the complex;

wherein the aqueous emulsion comprises 0.01-1 weight-% of lignin-carbohydrate complex, calculated from total weight of the aqueous emulsion; and wherein the aqueous emulsion is free of starch.

2. The aqueous emulsion according to claim 1, wherein the hydrophobic anhydride-based sizing agent is selected from the group consisting of alkenyl succinic anhydride, maleated vegetable oils, and fatty acid anhydrides.

3. The aqueous emulsion according to claim 1, wherein the anionic lignin-carbohydrate complex comprises anionic functional groups selected from sulfonate groups, carboxyl groups and/or phenolic groups.

4. The aqueous emulsion according to claim 1, wherein the lignin-carbohydrate complex has a weight average molecular weight MW in a range of 3500-90 000 g/mol.

5. The aqueous emulsion according to claim 1, wherein the anionic lignin-carbohydrate complex has an anionic charge density less than −0.2 meq/g, measured at pH 7.

6. The aqueous emulsion according to claim 1, wherein the lignin-carbohydrate complex comprises at least 15 weight-% of carbohydrates, calculated from total dry weight of the complex.

7. The aqueous emulsion according to claim 1, wherein the lignin-carbohydrate complex has a lignin: carbohydrate ratio from 90:10 to 10:90.

8. The aqueous emulsion according to claim 1, wherein the lignin-carbohydrate complex comprises galactose, glucose, mannose, arabinose and/or xylose residues, which are covalently bound to a lignin backbone.

9. The aqueous emulsion according to claim 1, wherein the aqueous emulsion comprises the lignin-carbohydrate complex and said hydrophobic anhydride-based sizing agent in a weight ratio from 0.05:1 to 0.5:1.

10. The aqueous emulsion according to claim 1, wherein the lignin-carbohydrate complex is obtained by enzymatic treatment of lignin-carbohydrate material originating from a pulping process.

11. The aqueous emulsion according to claim 1, wherein the anhydride-based sizing agent, dispersed in the aqueous phase of the emulsion, has a particle size D95 in a range of 0.5-10 μm.

12. The aqueous emulsion according to claim 1, wherein the aqueous emulsion comprises at least 0.5 weight-% of the hydrophobic anhydride-based sizing agent, given as active agent and calculated from the total weight of the emulsion.

13. The aqueous emulsion according to claim 1, wherein the aqueous emulsion comprises 0.05-0.7 weight-% of lignin-carbohydrate complex, calculated from total weight of the aqueous emulsion.

14. The aqueous emulsion according to claim 1, wherein the aqueous emulsion is stable at least 30 minutes, measured as a change of the particle size D95 as a function of time, wherein the particle size D95 changes less than 10% within the defined time period.

* * * * *